US009572443B2

(12) United States Patent
Osborne

(10) Patent No.: US 9,572,443 B2
(45) Date of Patent: Feb. 21, 2017

(54) CONTAINER WITH UTENSIL HOLDER

(75) Inventor: Mortissa Osborne, North Hollywood, CA (US)

(73) Assignee: Mortissa Osborne, North Hollywood, CA (US)

( * ) Notice: Subject to any disclaimer, the term of this patent is extended or adjusted under 35 U.S.C. 154(b) by 2434 days.

(21) Appl. No.: 12/045,964

(22) Filed: Mar. 11, 2008

(65) Prior Publication Data

US 2008/0149634 A1 Jun. 26, 2008

Related U.S. Application Data

(63) Continuation-in-part of application No. 11/516,985, filed on Sep. 7, 2006, now abandoned.

(60) Provisional application No. 60/714,767, filed on Sep. 8, 2005.

(51) Int. Cl.
*A47G 21/14* (2006.01)

(52) U.S. Cl.
CPC ..... *A47G 21/145* (2013.01)

(58) Field of Classification Search
CPC ..... A47G 21/145
USPC ..... 220/735, 521, 23.83, 529, 526, 528
See application file for complete search history.

(56) References Cited

U.S. PATENT DOCUMENTS

| | | | | | |
|---|---|---|---|---|---|
| 269,054 | A | * | 12/1882 | Hemsteger | 220/574 |
| 1,276,018 | A | * | 8/1918 | Blaetus | 220/735 |
| 1,393,574 | A | * | 10/1921 | Rohmiller | 220/735 |
| 1,607,863 | A | * | 11/1926 | Betts | 220/574 |
| 1,607,864 | A | * | 11/1926 | Butler | 220/574 |
| 1,652,935 | A | * | 12/1927 | Goldfield | 99/317 |
| 1,768,771 | A | * | 7/1930 | La Tourrette | 141/380 |
| 2,034,940 | A | * | 3/1936 | Butler | 220/735 |
| 2,175,735 | A | * | 10/1939 | Banks | 401/119 |
| 2,204,699 | A | * | 6/1940 | Robertson | 99/448 |
| 2,205,726 | A | * | 6/1940 | Lehman | 220/735 |
| 2,584,379 | A | * | 2/1952 | Chmielewski | 206/551 |
| 2,591,606 | A | * | 4/1952 | Reed | 99/316 |
| 2,609,854 | A | * | 9/1952 | Rosen | 150/124 |
| 2,757,405 | A | * | 8/1956 | Edwards | 15/264 |
| 2,918,203 | A | * | 12/1959 | Hodgson | 229/401 |
| 2,919,086 | A | * | 12/1959 | McMahan | 248/37.6 |
| 3,070,226 | A | * | 12/1962 | Mathison | 426/119 |
| 3,442,435 | A | * | 5/1969 | Huston et al. | 220/528 |
| 3,568,870 | A | * | 3/1971 | Elston | 215/388 |
| 3,657,994 | A | * | 4/1972 | Post | 99/323 |
| 3,679,093 | A | * | 7/1972 | Chang | 220/574 |
| 3,722,779 | A | * | 3/1973 | Chang | 220/574 |
| 3,921,889 | A | * | 11/1975 | Gibbons | 229/103.1 |
| 4,095,716 | A | * | 6/1978 | Meany | 215/391 |
| 4,106,486 | A | * | 8/1978 | Lee | 126/369 |
| 4,452,581 | A | * | 6/1984 | Panehal | 425/464 |

(Continued)

FOREIGN PATENT DOCUMENTS

| | | |
|---|---|---|
| JP | 62-90582 | 6/1987 |
| JP | 6-45489 | 6/1994 |
| KR | 2020050007203 | 6/2005 |

*Primary Examiner* — Fenn Mathew
(74) *Attorney, Agent, or Firm* — Steptoe & Johnson LLP

(57) ABSTRACT

A serving container includes a structure for holding one or more utensils. In one approach, a removable insert is provided within the holding structure. In another approach, the holding structure is removable and forms a part of the sidewall of the serving container. The holding structure can also be embodied in a ledge sized to receive a handle of a utensil or can be formed on a lid to the serving container.

9 Claims, 6 Drawing Sheets

(56) References Cited

U.S. PATENT DOCUMENTS

| | | | | | |
|---|---|---|---|---|---|
| 4,573,631 | A | * | 3/1986 | Reeves | 229/404 |
| 4,867,410 | A | | 9/1989 | Jurgich | |
| 5,042,712 | A | * | 8/1991 | DeRoseau | 229/401 |
| 5,105,963 | A | * | 4/1992 | Scott | 220/735 |
| 5,139,166 | A | * | 8/1992 | Smith | 220/574 |
| 5,178,354 | A | * | 1/1993 | Engvall | 248/316.7 |
| 5,222,622 | A | * | 6/1993 | Laske, Jr. | 220/574.1 |
| 5,224,646 | A | * | 7/1993 | Biancosino | 229/4.5 |
| D337,920 | S | * | 8/1993 | Rowe | D7/507 |
| 5,251,758 | A | * | 10/1993 | Kolacek | 206/542 |
| 5,482,095 | A | * | 1/1996 | de Chollet | 141/380 |
| 5,526,924 | A | * | 6/1996 | Klutznick | 206/5 |
| 5,551,591 | A | * | 9/1996 | Laib | 220/528 |
| 5,638,981 | A | * | 6/1997 | Crane et al. | 220/574.1 |
| 5,699,564 | A | * | 12/1997 | Heh | 5/503.1 |
| 5,746,113 | A | * | 5/1998 | Ko | 99/323 |
| 5,938,066 | A | * | 8/1999 | DeMars | 220/574.1 |
| 6,029,723 | A | * | 2/2000 | Baquero et al. | 150/105 |
| 6,412,653 | B1 | * | 7/2002 | Waterhouse | 220/556 |
| 6,425,317 | B1 | * | 7/2002 | Simmons | 99/299 |
| 6,604,646 | B2 | * | 8/2003 | Torniainen et al. | 220/212 |
| 7,086,437 | B1 | * | 8/2006 | Michael | 150/103 |
| 7,464,475 | B2 | * | 12/2008 | Tsao | 30/327 |
| 7,500,579 | B2 | * | 3/2009 | Crossley | 220/703 |
| 2002/0108952 | A1 | * | 8/2002 | Delman et al. | 220/212 |
| 2003/0209512 | A1 | * | 11/2003 | Guyot | 215/355 |
| 2004/0178199 | A1 | * | 9/2004 | Stroup | 220/212 |
| 2006/0021990 | A1 | * | 2/2006 | Friedman | 220/703 |
| 2010/0051631 | A1 | * | 3/2010 | Blomdahl et al. | 220/735 |

* cited by examiner

CONTAINER WITH UTENSIL HOLDER

This application is a continuation-in-part of U.S. Ser. No. 11/516,985, filed Sep. 7, 2006, which is based upon provisional application No. 60/714,767, filed Sep. 8, 2005. This invention relates to food containers that are used in conjunction with a serving utensil, including containers such as salad bowls, platters and dishes for serving meats, vegetables, soups, desserts, condiments and the like.

FIELD OF THE INVENTION

Background of the Invention

Individuals and the food industry have always sought ways to efficiently serve food without contamination of the food, the container, or any associated serving utensils. Contamination problems can arise when serving utensils are separated from their container. For example, a serving spoon or fork can lay on a dirty surface where the container rests. Another undesirable situation can occur if a serving utensil is handled by someone with, say, a cold or the flu, after which the utensil falls into the container and contaminates the contents of the container with a virus that can spread to others who eat or come in contact with the contents of the container. In other instances, it is desirable to keep the serving utensils separate from the food, to prevent food from getting on the handle of the serving utensil, making it difficult or messy to grip. Another reason to keep serving utensils separate from the food is to prevent the taste of food in one container from being altered by being mixed with the taste of food in another container, should the serving utensils be switched between the containers. It is also desirable to keep the utensil or utensils as part of serving arrangement that includes the serving container.

Various combinations of containers and serving utensils can be seen in the prior art. For example, U.S. Pat. No. 269,054 to Hemsteger depicts a spoon holder for a cooking vessel. U.S. Pat. No. 1,607,863 to Betts depicts a combination of a disposable receptacle and spoon for ice cream. Nevertheless, it is desirable to have a serving container with a separate pocket or compartment for one or more serving utensils.

SUMMARY OF THE DISCLOSURE

The invention includes a container for use with one or more serving utensils, such as forks or spoons. The utensils have a serving portion and a handle. A serving container has a utensil pocket on the container portion for holding the serving portion of the utensil. At the same time, the arrangement of the pocket and the container hold the utensil so that easy access to the utensil handle is maintained. In such a manner, the container can continually be used for serving.

In one particular approach, a removable insert or sleeve is received within the utensil pocket. In another approach, the utensil pocket is removable and forms a sidewall of the serving container. In yet other approaches, the serving container is provided with a ledge which is sized and shaped to receive a handle of a utensil and a cover to the serving container can be equipped with a recess for receiving a utensil.

Other features of the invention include a detachably mounted pocket piece that makes the use of the pocket and the container optional. The pocket piece can also have secondary means to further secure the utensil inside the pocket. Such a means could include a magnet, a latch, a hook, or other types of mechanical fasteners. The pocket piece can also be configured so that it forms a pocket inside or outside the container.

DETAILED DESCRIPTION

Figure 1:
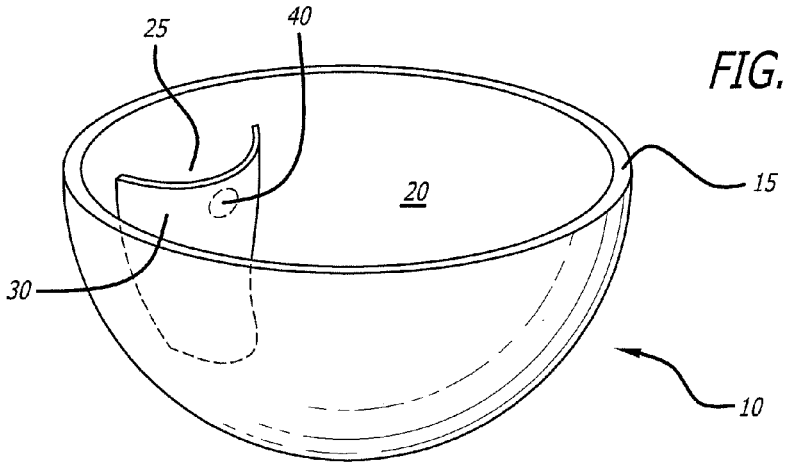
FIG. 1 is a perspective view of a serving container with a utensil pocket on the inside of the container.
Figure 2:
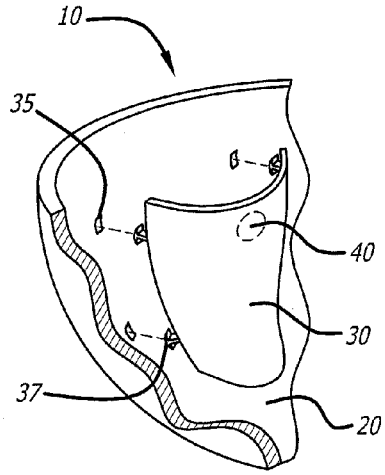
FIG. 2 is a portion of the perspective view of FIG. 1 depicting how the pocket can be formed by a removable pocket piece.

The present invention includes several embodiments, some of which are illustrated by the preceding drawings. FIG. 1 depicts a serving container 10, such as a salad bowl. The container 10 includes an interior surface 20 that defines a food containing portion of the container 10. A pocket piece 30 defines a pocket or compartment 25. The pocket piece 30 can be detachably mounted to the inside or the outside of the container, although the present invention also contemplates a permanent pocket as well. FIG. 2 depicts a pocket piece 30 with clips 37 that snap into openings 35 to secure the pocket piece to the interior of the container 10.

Figure 3:
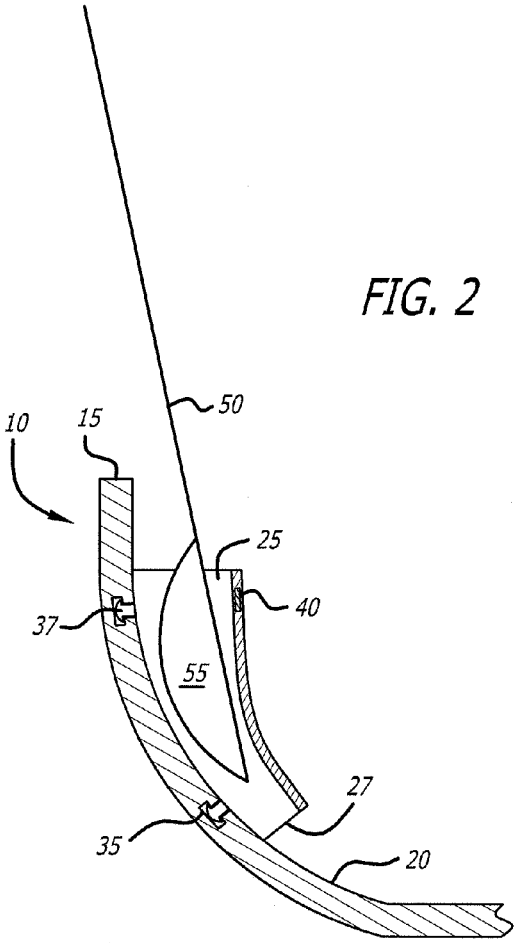
FIG. 3 is a section view of the pocket and container in FIGS. 1 and 2, showing a utensil in the pocket.

FIG. 3 shows a spoon 55 with handle 50 resting inside pocket 25. The pocket can be sized for one more utensils. In another embodiment, two pockets (not shown) could be disposed inside or outside of the container. Such a configuration would be helpful when the container is used as a salad bowl, in which two large utensils may be used simultaneously for serving purposes. It is intended that the utensil pocket be placed in relation to the container so that the serving portion of the utensil is held by the pocket, as depicted in FIG. 3, where pocket 25 holds spoon 55 while the spoon handle 50 is easily accessible. It is not intended that the pocket have a specific proportional relationship to the utensil, the utensil's handle, or the utensil's serving portion. It is, however, desired that the utensil handle be easily accessible for continued use of the serving container.

Magnet 40 can assist in securing a ferromagnetic utensil inside the pocket 25. Other types of securing devices can also be used, such as clips and slots (not shown) that mechanically secure the utensil inside the pocket. Such securing arrangements would preferably be placed on the pocket piece 40, but could also be disposed on the interior surface 20 of container 10 or on the tope edge 15. Another way of securing the utensil inside the pocket 25 is to match the utensil and pocket sizes like a matched set, in which the utensil and container would be sold as a pair. The pocket would be shaped and sized to mechanically secure the serving part of the utensil in the pocket. The precise shape, size, and location of the pocket or pockets can be determined by one of ordinary skill to accommodate the desired shape and size of the container and the utensils.

Figure 4:
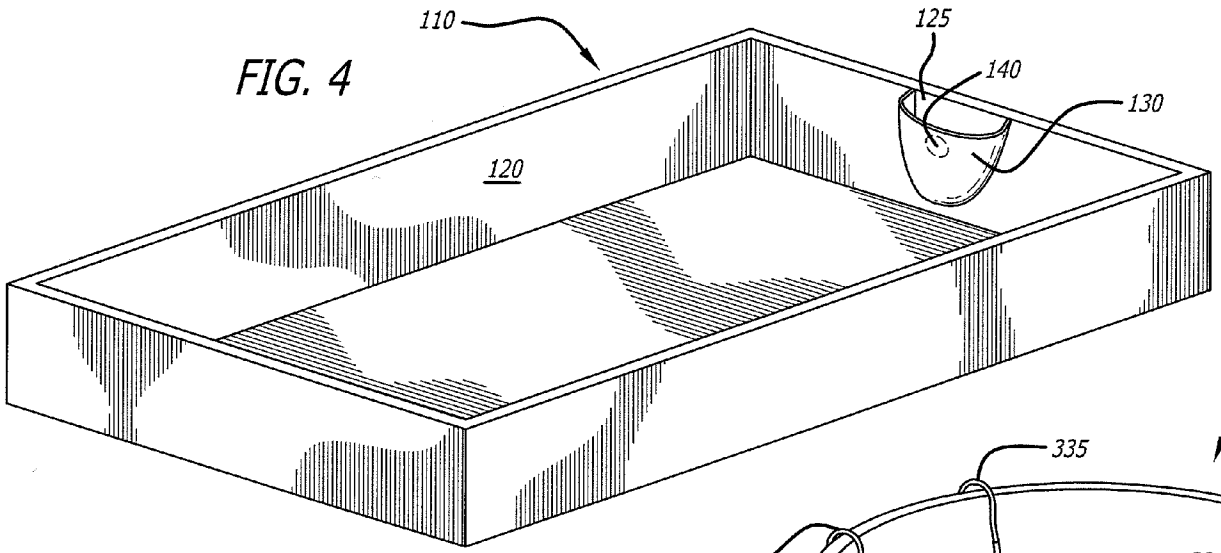
FIG. 4 is a perspective view of an alternate tray or dish-like embodiment of the container in FIG. 1.

FIG. 4 depicts an alternate embodiment of the invention, in which the serving container 110 is in the shape of a pan or serving platter with raised sides 120. The pocket piece 130, which forms utensil pocket or compartment 125, can be permanently or detachably mounted to the container 110. A magnet or other utensil securing device 140 is also shown.

Figure 5:
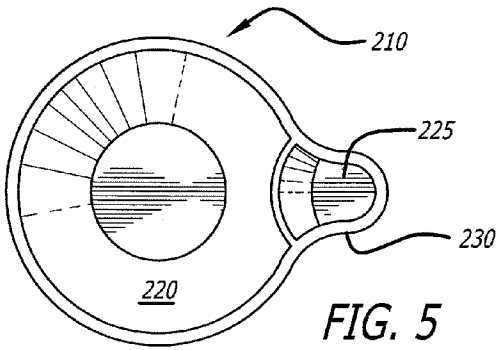
FIG. 5 is a plan view of yet another embodiment in which the utensil pocket is outside of the container.

FIG. 5 depicts yet another embodiment of the invention. A container or bowl 210 includes a pocket 225 disposed on the outside of the container 210. In FIG. 5, the pocket piece 230 is depicted as a permanent part of the entire container 210. As noted earlier, however, other embodiments can include a detachably mounted pocket piece (or pieces). Moreover, the pocket 225 can be positioned within the container 210 and can be built into a middle of the container 210.

Figure 6:
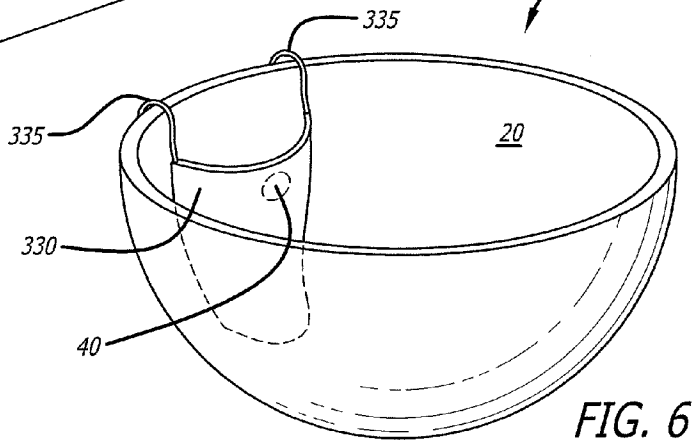
FIG. 6 shows an alternate embodiment of the removable pocket piece depicted in FIG. 2.

FIG. 6 depicts the container 10 of FIG. 1. In FIG. 6, however, the pocket piece 330 is configured differently from that of FIG. 1. In particular, a pair of wire hooks 335 are attached to the top of pocket piece 330 and hook over the top of container 10.

Other possible embodiments of the present invention will be understood by those of skill in the art. For example, it is contemplated that the pocket pieces in FIGS. 3 and 6 form pockets that are open on the bottom. Referring specifically to FIG. 3, any drippings or loose food in spoon 55 could fall through the bottom opening 27 of pocket 25 and into the container 10. Alternatively, in FIGS. 4 and 5, the bottoms of pockets 125 and 225 respectively are intended to be closed. Likewise, those of skill in the art will appreciate that there are a variety of ways to detachably mount the pocket piece to the container.

Figure 7:
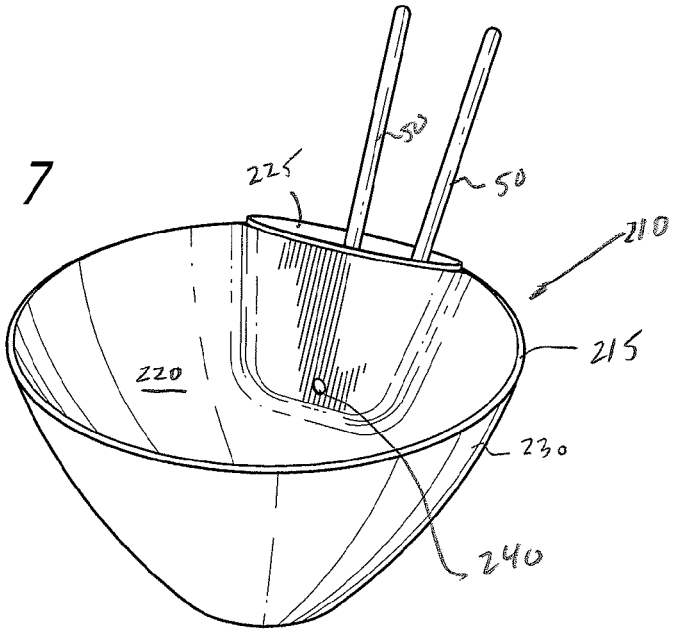
FIG. 7 is a perspective view, depicting a serving container including a removable insert.
Figure 8:
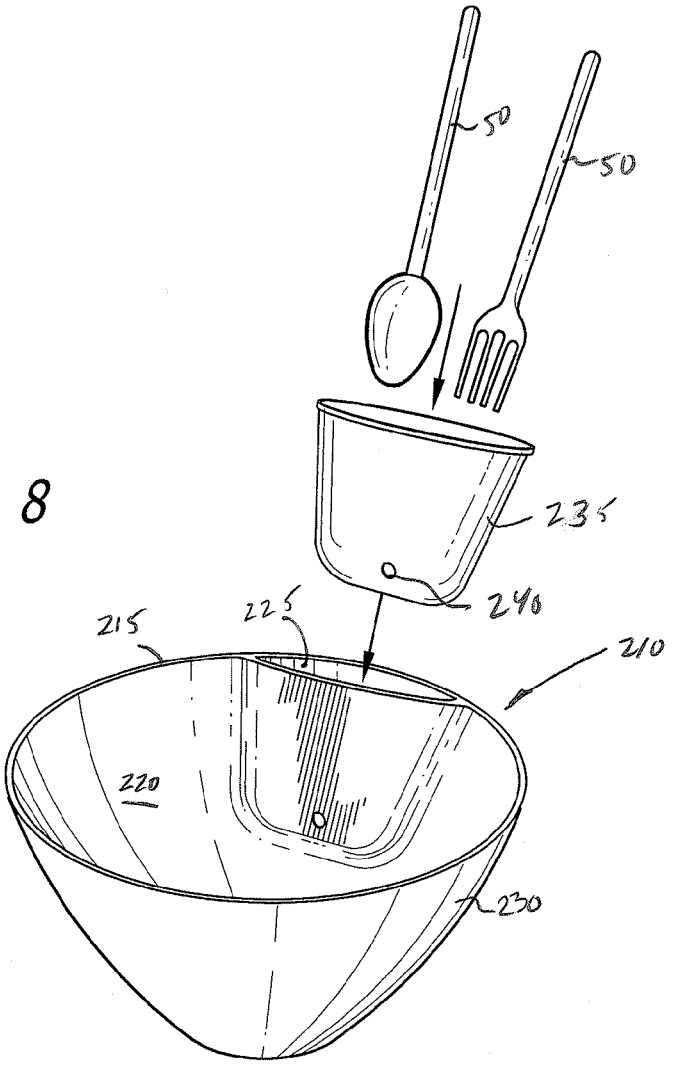
FIG. 8 is a perspective view, depicting the device of FIG. 7 with the insert removed.

Additionally, as shown in FIGS. 7 and 8, a container 210 with a top edge 215 can include an interior 220 and a pocket 225 formed in a sidewall 230 of the container 210. In the depicted approach, the pocket 225 shares the top edge 215 with a remaining portion of the container 210. A pocket insert 235 is further provided for removable insertion into the pocket 225. Each of the pocket 225 and insert 235 can be equipped with drainage holes 240. It is to be recognized that the pocket 225 can be arranged at various angles. In one approach, the pocket 225 can tilt at an angle such that the utensil 50 will face the user.

Figure 9:
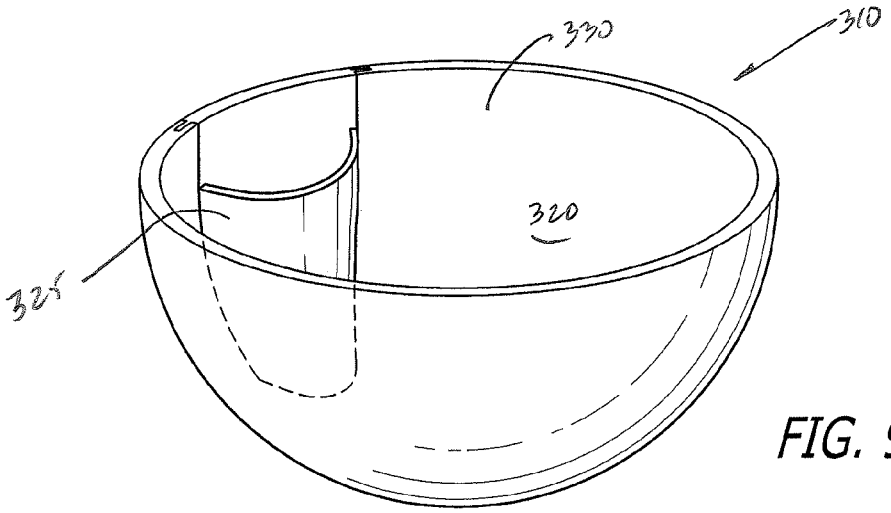
FIG. 9 is a perspective view, depicting a serving container with a removable pocket forming a sidewall of the container.
Figure 10:
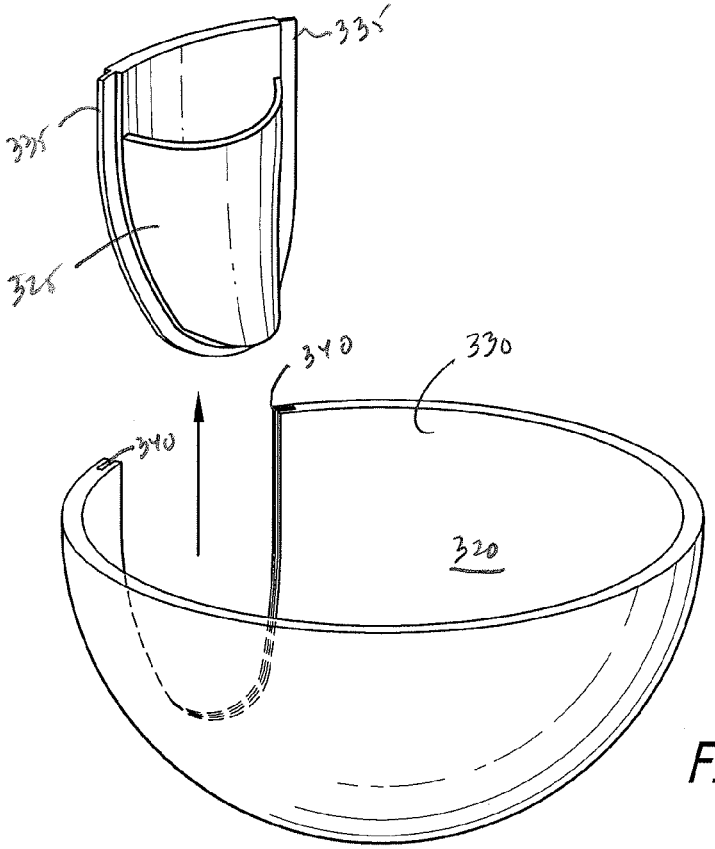
FIG. 10 is a perspective view, depicting the device of FIG. 9 with the pocket removed.

In another approach, with reference to FIGS. 9 and 10, a container 310 having an interior 320 can include another embodiment of a pocket 325. In this approach, the pocket 325 forms a portion of a sidewall 330 of the container 310. A peripheral edge 335 of the pocket 325 is sized and shaped to be slideably received within a recess 340 formed in the container 310.

Figure 11:
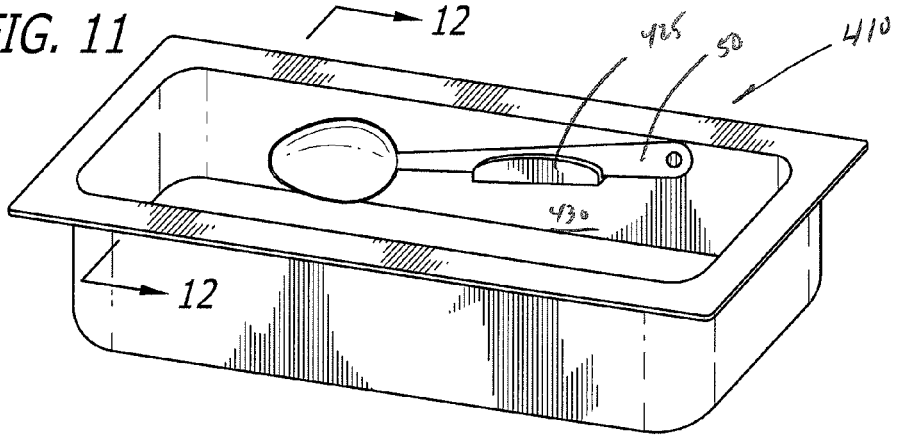
FIG. 11 is a perspective view, depicting a serving container with a ledge for receiving a handle of a utensil.
Figure 12:
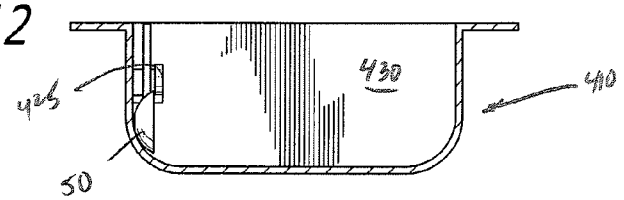
FIG. 12 is a cross-sectional view taken along lines 12-12, depicting the position of the utensil within the serving container.
Figure 13:
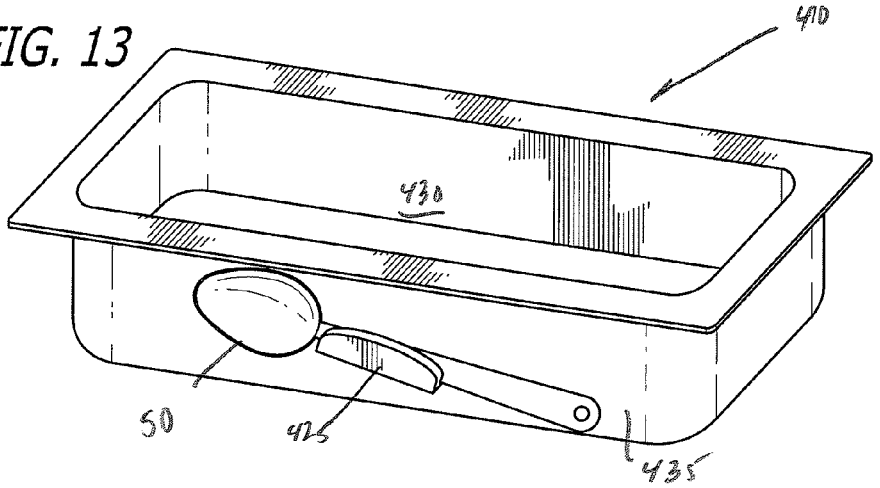
FIG. 13 is a perspective view, depicting a serving container with a ledge configured on an outside surface.

Turning now to FIGS. 11-13, there is shown yet another approach to a container 410, wherein utensil pocket structure is embodied in a ledge 425 sized and shaped to receive a portion of a utensil 50. Such a ledge 425 can be angled so that easy access is provided to a handle of the utensil 50. Moreover, the ledge 425 can be positioned within an interior 430 or on an exterior surface 435 of the container. It has been recognized that it may be beneficial for the utensil pocket or holder of these or each of the disclosed embodiments to be formed from heat resistant material so that heat from the food container is not transmitted to the holder or pocket and then to the utensil.

Figure 14:
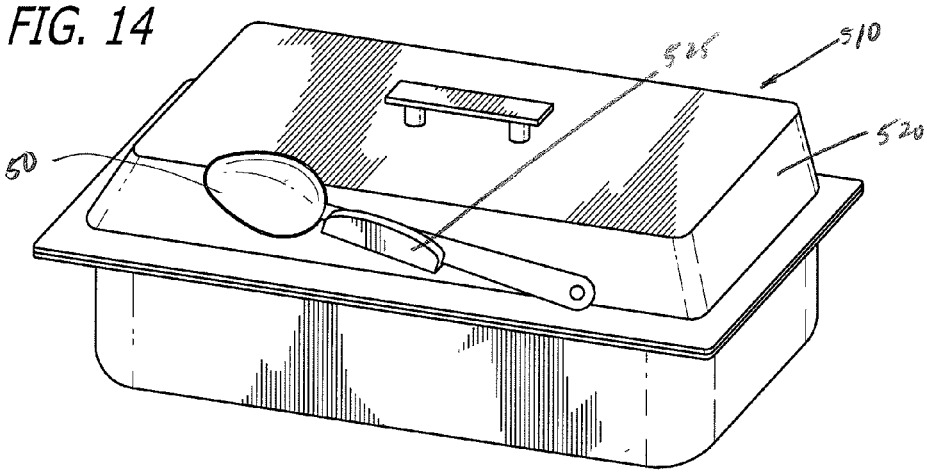
FIG. 14 is a perspective view, depicting a lid of serving container within a ledge for receiving a utensil.

In a related approach (FIG. 14), a container 510 can include a lid 520. A pocket or utensil holder such as ledge structure 525 is configured onto or within the lid 520 of the container 510. As with the above approaches, it is contemplated that the holder can be formed from heat resistant material so that an utensil retained therein will not get hot.

Figure 15:
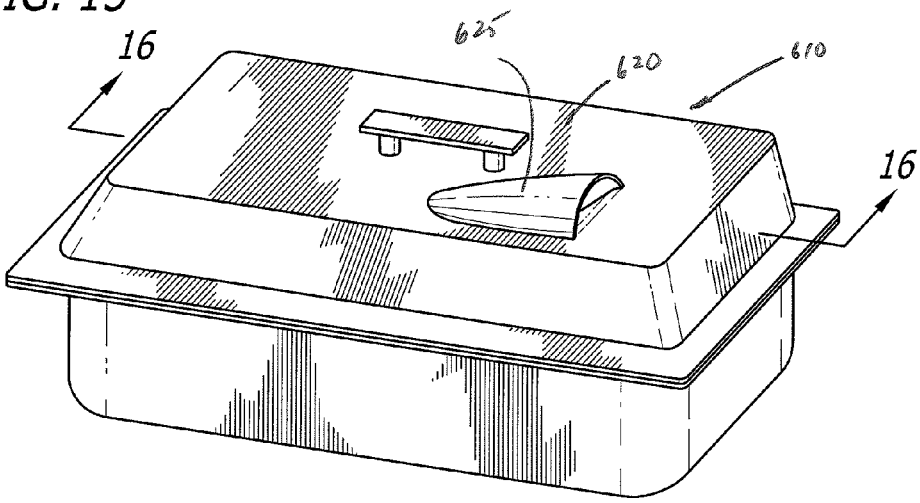
FIG. 15 is a perspective view, depicting a serving container with a pocket formed in a lid.
Figure 16:
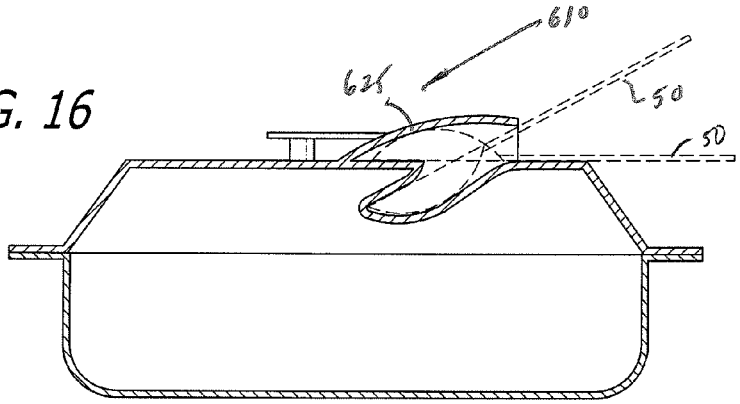
FIG. 16 is a cross-sectional view, depicting a position of a utensil within the pocket of the device of FIG. 15.

Further, as shown in FIGS. 15 and 16, a container 610 can include a lid 620 having a pocket 625 formed therein. In this approach, the pocket 625 can include multiple recesses of varying shapes to receive different utensils 50 or an utensil 50 placed within the pocket 625 in various orientations. Again, it is contemplated that the pockets 625 can be formed from heat resistant material so that an utensil placed therein will not become hot. Moreover, it is further contemplated that an insert, such as that described above, can be placed in the pocket 625.

Furthermore, the disclosed containers, whether in the form of a tray or bowl or other structure can be formed from inexpensive, disposable material. In this way, after use, the container can be disposed of without requiring cleaning.

Therefore, it will be understood by those of skill in the art that changes may be made to the present invention, and that changes in its use may also be made, without departing from the spirit of the invention, which is defined in the following claims.

We claim:

1. A container for use with one or more serving utensils, comprising:

a container portion having a sidewall;

a utensil pocket formed within the sidewall of the container portion and including an upper opening defining a continuous hoop-shaped rim; and a removable insert configured within the utensil pocket.

2. The container of claim 1, wherein the removable insert includes a drainage hole.

3. The container of claim 1, wherein the pocket includes a drainage hole.

4. The container of claim 1, further comprising a secondary utensil pocket that is in the form of a ledge sized and shaped to receive a handle of an utensil.

5. The container of claim 4, wherein the ledge is formed on an interior of the container portion.

6. The container of claim 4, wherein the ledge is formed on an exterior of the container portion.

7. The container of claim 4, wherein the container includes a lid and the ledge is attached to the lid.

8. The container of claim 1, wherein the utensil pocket forms a top edge with the remaining portion of the container portion.

9. The container of claim 1, wherein the utensil pocket tilts at an angle relative to the sidewall of the container portion.

* * * * *